United States Patent [19]

Kunkel et al.

[11] 4,258,806

[45] Mar. 31, 1981

[54] ROTARY DRILL BIT WITH ROTARY CUTTERS

[75] Inventors: Heinrich Kunkel; Armin Olschewski, both of Schweinfurt; Manfred Brandenstein, Aschfeld; Lothar Walter, Schweinfurt; Horst M. Ernst, Eltingshausen, all of Fed. Rep. of Germany

[73] Assignees: Sandvik AB, Sandviken; Aktiebolaget SKF, Gothenburg, both of Sweden

[21] Appl. No.: 42,925

[22] Filed: May 29, 1979

[30] Foreign Application Priority Data

Sep. 27, 1978 [DE] Fed. Rep. of Germany ..... 2841971

[51] Int. Cl.[3] ..... E21B 10/20; E21B 10/22

[52] U.S. Cl. ..... 175/370; 175/372

[58] Field of Search ..... 175/227, 228, 229, 337, 175/370, 371, 372; 308/8.2

[56] References Cited

U.S. PATENT DOCUMENTS

| | | | |
|---|---|---|---|
| 1,905,079 | 4/1933 | Wellensiek et al. | 308/8.2 |
| 2,194,675 | 3/1940 | Sanders et al. | 308/8.2 |
| 2,235,548 | 3/1941 | Bozeman | 175/227 |
| 2,293,603 | 8/1942 | Francis | 308/8.2 |
| 2,676,790 | 4/1954 | Turner | 175/370 |

FOREIGN PATENT DOCUMENTS

| | | | |
|---|---|---|---|
| 248586 | 7/1969 | U.S.S.R. | 175/372 |
| 307174 | 6/1971 | U.S.S.R. | 175/372 |
| 398732 | 9/1973 | U.S.S.R. | 175/371 |

*Primary Examiner*—James A. Leppink
*Assistant Examiner*—Richard E. Favreau
*Attorney, Agent, or Firm*—Eugene E. Renz, Jr.

[57] ABSTRACT

A rotary drill bit having a drill bit body and at least one trunnion projecting from the drill bit body and a rotary cutter supported on at least one pair of radial rolling bearings on the trunnion. The rolling elements of at least one bearing are guided on at last one axial end facing the drill bit body in an outer bearing race groove incorporated in the bore of the rotary cutter. The inner bearing groove is formed on the trunnion for the rolling elements of the radial roller bearing. A filling opening is provided for assembly of the rolling elements comprising a channel which extends through the drill bit body and trunnion and is essentially axially oriented having one terminal end adjacent the inner bearing race groove and at least one filler piece for sealing the opening. The filling opening is arranged to provide a common filling means for each radial bearing.

4 Claims, 5 Drawing Figures

ROTARY DRILL BIT WITH ROTARY CUTTERS

BACKGROUND OF THE INVENTION

The present invention relates to drilling apparatus used in the exploration of underground petroleum reserves and more specifically to a rotary drill bit having a plurality of rotary cutters supported for rotation on the drill bit body by a plurality of rolling elements, the rolling elements being laterally guided at least at their axial ends facing the drill bit body in a radially disposed outer bearing race groove incorporated in the bore of the rotary cutter.

Rotary drill bits having conically shaped rotary cutters are known wherein the rotary cutters are supported on a trunnion formed integrally with the drill bit body and a radial roller bearing. The rollers of this bearing are laterally guided in a bearing race groove in the bore of the rotary cutter and supported in place at their axial ends facing away from the drill bit body by means of a flange bolt secured in the trunnion so that each rotary cutter is mounted in a manner preventing removal from the trunnion. An arrangement of this type is shown in the British Pat. No. 456,570. This known assembly has several disadvantages and drawbacks. For example, the construction requires that the flange bolt be shaped in the form of a race element for the axial bearing of the rotary cutter and be made of an expensive bearing material. In order to mount the flange bolt in a precise manner in the trunnion, the bolt has to be machined with close tolerances. Thus, the method of manufacturing is relatively costly. Additionally, a center bore with a relatively large diameter must be provided in the trunnion to receive the highly stressed flange bolt and accordingly, the trunnion of the drill bit body is somewhat weakened and consequently there is the risk of trunnion failure by breakage especially in heavy duty operations.

In accordance with another known rotary drill bit assembly, the rotary cutters are each supported on a trunnion connected in one piece with the drill bit body in a radial rolling bearing with conical roller elements. This arrangement has the advantage of providing a trunnion which is relatively rigid and possesses good load bearing characteristics. However, a so-called edge ring is required which is located in the bore of the rotary cutter on the side of the roller elements facing the drill bit body which axially guides the roller elements to support the rotary cutter in place on the trunnion. It has been found that the fabrication of the rotary cutter is rather expensive because of the incorporation of the additional edge ring. Furthermore, in heavy duty operations with high impact stresses, it has been observed that a loosening of the edge ring may result and accordingly, presents the disadvantage that the rotary cutter is not adequately secured against being drawn off the trunnion. A weakening of the trunnion through several filling openings, one for each radial rolling bearing, is to be overcome.

SUMMARY OF THE INVENTION

With the foregoing in mind, it is an object of the present invention to provide an improved rotary drill bit which is characterized by novel features of construction and arrangement including the provision of only a single filling opening in the trunnion for assembly of the rolling elements for several radial roller bearings so that the trunnion can be constructed very strong and rigid without appreciable weakening as a result of plural filling openings.

In accordance with another feature of the present invention, the filling opening may be sealed with several tightly connected filler pieces. This facilitates assembly of all the rollers of several adjacent rows of rollers from a common filling opening. For example, after completing insertion of the rolling elements of the inside radial roller bearing opposite the filling opening, the appropriate bearing race groove of the trunnion can be sealed with an inside filler piece and the rolling elements of the outside radial rolling bearing which are adjacently arranged can be filled without obstruction through the same filling opening into their respective bearing race groove on the trunnion before the filling opening is sealed with an additional filler piece. The cutting rollers of the rotary drill bit are held in place securely and in an impact resistant manner preventing withdrawal from the trunnion via the rolling elements of at least one of the roller bearings. This produces a comparatively simplified construction which is easily fabricated.

In the rotary drill bit illustrated the rolling elements of the radial roller bearings are guided between the edges of the inside bearing race groove, are firmly supported on the trunnion and are laterally held in place. In this manner there is no danger of the bearing race groove edges becoming loose. The trunnion has a filling opening for insertion of the rolling elements of the radial roller bearings which is of comparatively small diameter and does not detract appreciably from the strength of the trunnion. The trunnion of each rotary cutter may be constructed in one piece with the drill bit body thus providing a further simplification of the fabrication and assembly of the roller bit since the assembly comprises relatively few parts. These parts are comparatively easy to machine so that the fabrication and assembly of the rotary drill bit is simple and economical.

Still a further feature of the rotary drill bit is the provision of an arrangement wherein the outside bearing race groove in the rotary cutter as well as the inside bearing race groove on the trunnion of the radial roller bearing have a relatively large groove depth providing a good lateral guidance of the rolling elements and strong impact resistant edges of the bearing race grooves. The filling opening for the rolling elements in the trunnion is of optimally small cross section and does not harmfully effect the good strength characteristics of the trunnion.

A still further object is to provide an improved rotary drill bit wherein the filling opening disposed in the machine bearing race groove is located in the unstressed zone of the radial roller bearing so that the load bearing ability of the radial roller bearing is not effected by this filling opening. Additionally, the filling opening is adjacent the inside heavy walled portion of the drill bit body so that a relatively strong break-proof connection is guaranteed between the trunnion and the drill bit body. In accordance with another feature of the rotary drill bit the outside peripheral surface of the trunnion is supplemented by the correspondingly shaped end surface of a filler piece in such a manner that harmful holes and discontinuities are not present in this outside surface. The specific construction of the filler piece completely seals to complement the inside bearing race groove at the filling opening location without disturbing the rolling kinematics of the rolling elements.

BRIEF DESCRIPTION OF THE DRAWINGS

These and other objects of the present invention of the various features and details of the operation and construction thereof are hereinafter more fully set forth with reference to the accompanying drawings, wherein.

DESCRIPTION OF THE PREFERRED EMBODIMENTS

Figure 1:
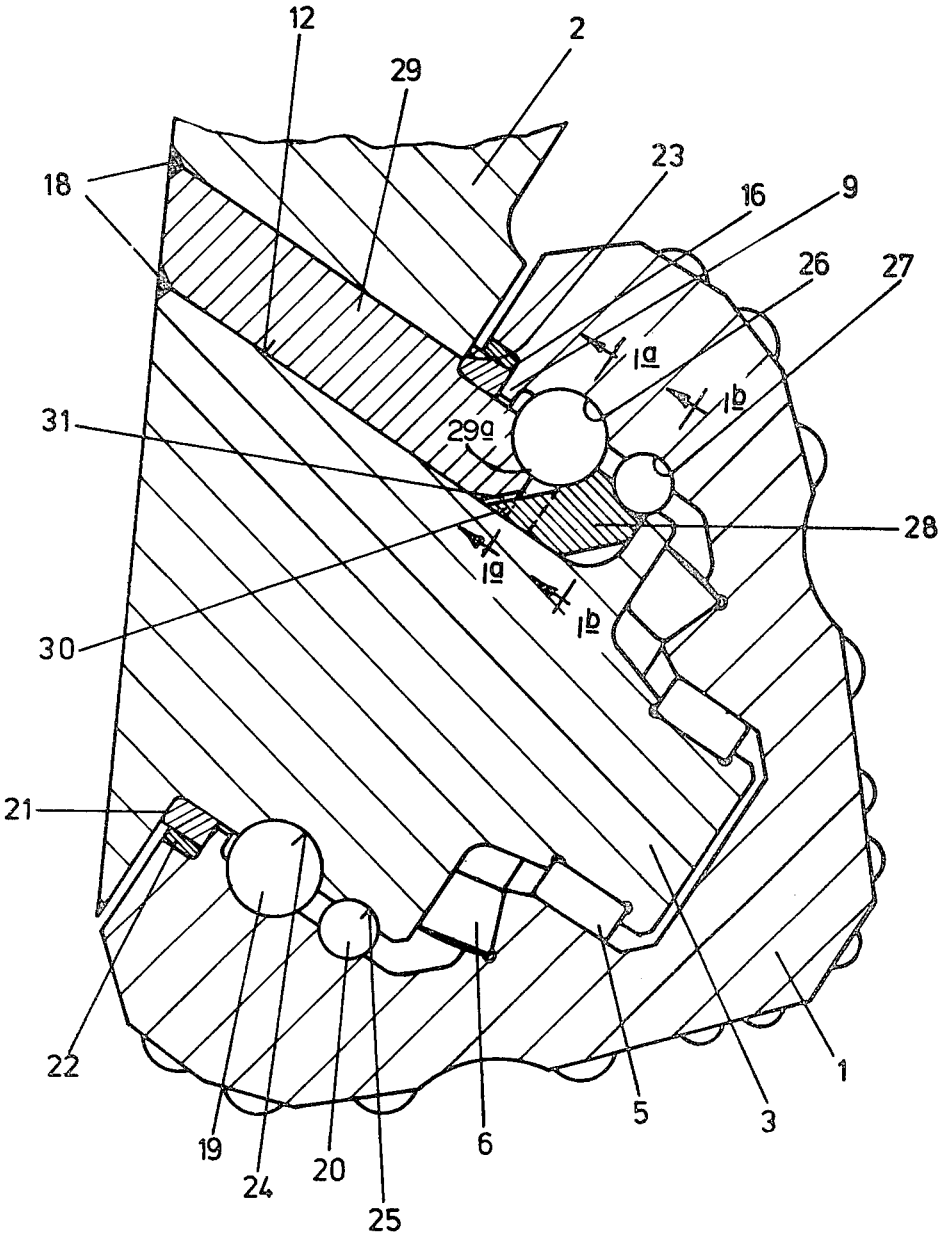
FIG. 1 is a longitudinal sectional view through a rotary cutter of a rotary drill bit in accordance with the present invention.
Figure 1A:
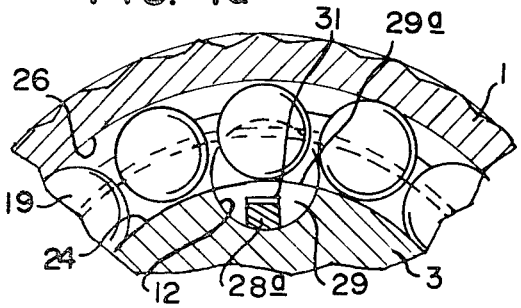
FIG. 1*a* is a fragmentary sectional view taken on lines 1*a*—1*a* of FIG. 1.
Figure 1B:
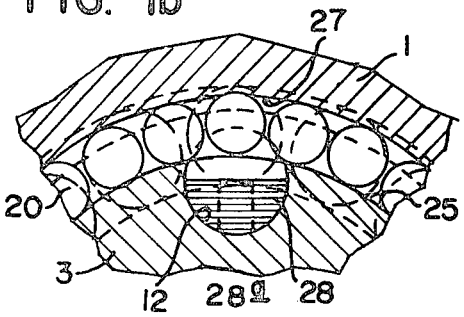
FIG. 1*b* is a fragmentary sectional view taken on lines 1*b*—1*b* of FIG. 1.

Referring now to the drawings and particularly to FIG. 1 thereof, there is illustrated one of a plurality of conical rotary cutters of a rotary drill bit constructed in accordance with the present invention. As illustrated, the rotary cutter which is generally designated by the numeral 1 is rotatably supported on the trunnion 3, which, in the present instance, is formed integrally with the drill bit body 2. The bearing support illustrated includes an outer ball bearing 19 and 20 with ball shaped rolling elements, an inner radial bearing 5 with cylindrical rolling elements and intermediate axial bearing 6 with conical rolling elements. The ball bearings 19, 20 facing the drill bit body run in the base of the outer bearing race groove 24 and 25 formed radially in the rotary cutter 1.

In accordance with the present invention, the outer bearing support comprises a radial ball bearing 19 facing the drill bit body and an adjacent radial ball bearing 20 having balls of a smaller diameter and disposed remote from the drill bit body between the axial roller bearing 6 and the larger ball bearing 19. Because of the higher stresses at the outer end of the rotary cutter adjacent the drill bit body, the balls of the radial bearing 19 are of a larger diameter than the balls of the radial bearing 20.

At the outer end of the rotary cutter facing the drill bit body romote from the tip end, an elastic seal 21 is provided which is supported in a mounting case 22. As illustrated, the seal 21 slides on the front face of the drill bit body 2 and on the outside surface 16 of the trunnion 3.

The confronting surfaces of the trunnion and rotary cutter are provided with circumferentially extending inner and outer raceways for the bearings 19 and 20. In the present instance the bearing race grooves 24 and 25 form the inner raceway surfaces for the adjacent rows of balls and race grooves 26 and 27 formed in the bore of the rotary cutter provide the outer raceways for the balls of the bearings 19 and 20. In this manner the rotary cutter 1 is, therefore, secured against being drawn off the trunnion 3 via the rolling elements of the radial bearings 19 and 20.

In the present instance the filler opening 12 is sealed with an inside filler piece 28 and an outside filler piece 29, the inside filler piece 28 sealing the bearing race groove 25 and the outside filler piece 29, the bearing race 24. As illustrated, the inside filler piece 28 has an axial projection 28*a* which seats in a recess or pocket 31 in the inner terminal end of the outside filler piece 29. The filler pieces 28 and 29 are thus tightly connected with each other when the projection 28*a* nests or engages in the pocket 31. Consequently the two filler pieces 28 and 29 are secured against twisting or rotation relative to one another in the filler opening 12.

Considering now briefly assembly of a rotary drill bit in accordance with the present invention, the cylindrical rollers of the radial bearing 5 are installed on the trunnion 3 and the conical rollers of the axial bearing 6 are installed in the bore of the rotary cutter. The rotary cutter then is axially positioned on the trunnion 3 until the conical rollers contact. The radial face of the trunnion forms one of the raceways for the bearing 6. The small balls of the bearing 20 are then inserted through the filler opening 12 to fill the annular space between the raceways 25 and 27. The inside filler piece 28 is then inserted into the filler opening 12 with the projection 30 facing rearwardly until it bottoms in the filling opening 12 and in this position seals the bearing race 25 of the trunnion 3. The larger balls are then fed through the filler opening 12. The filler opening is of a cross sectional dimension at the juncture of the shoulder 9 slightly larger than the diameter of the balls 19 to permit passage of the balls 19 into the annular space defining the raceways 24 and 26. The inclined configuration of the inside filler piece serves as a ramp guiding the balls into the annular space. After this filling operation has been completed, the outside filler piece 29 is inserted into the filler opening so that the bearing race groove 24 is sealed at the periphery. The outside filler piece 29 is then firmly secured to the drill bit body by means of the weld 18. The filling opening is, moreover, arranged in such a way that it exits in the zone of the radial bearings 19 and 20 at the bearing race grooves 24 and 25 which are less stressed than the outer raceways.

Figures 2, 3:
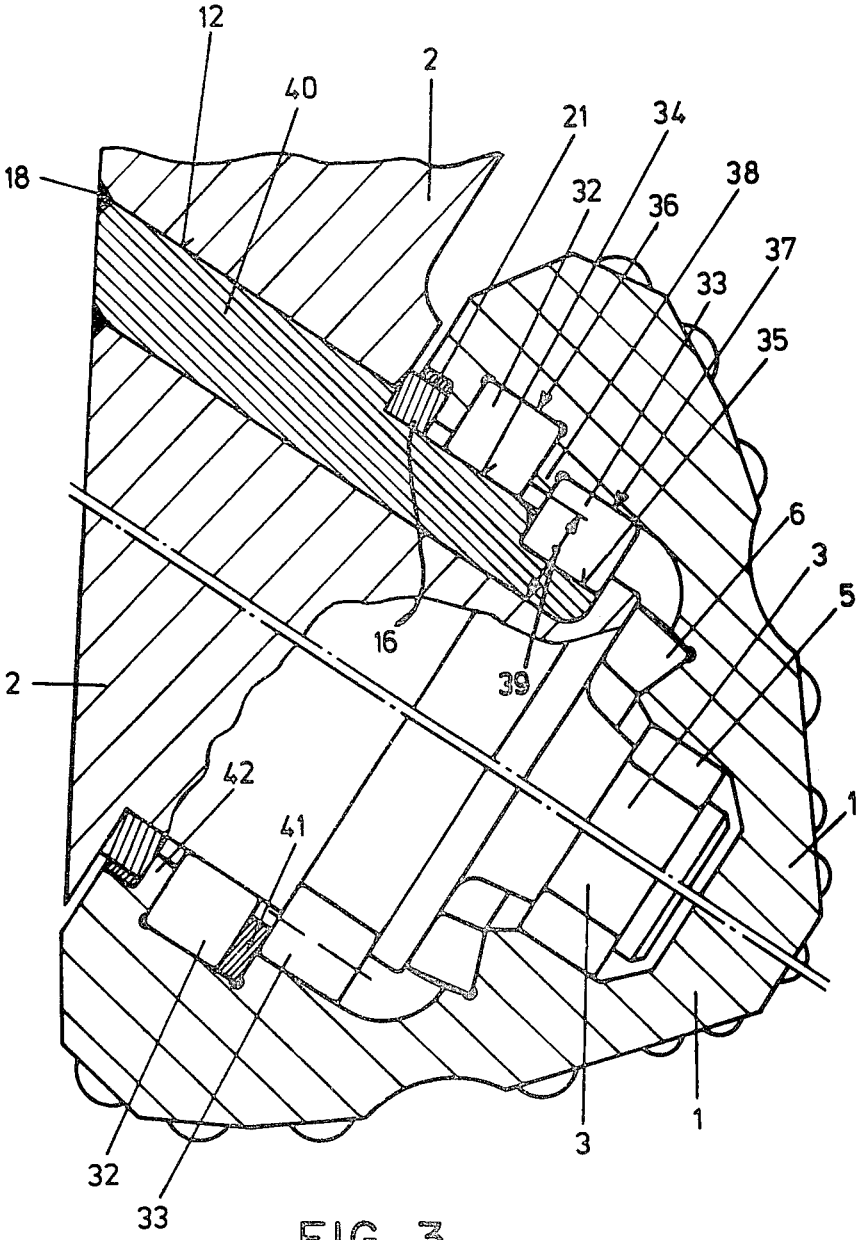
FIG. 2 is a fragmentary longitudinal sectional view through a rotary cutter of another embodiment of rotary drill bit in accordance with the present invention.
FIG. 3 is a fragmentary longitudinal sectional view through the rotary cutter of still another modified embodiment of rotary drill bit in accordance with the present invention.

A further modified form of rotary drill bit in accordance with the present invention is illustrated in FIG. 2. As illustrated, the rotary cutter is supported by bearing means on a trunnion formed integrally with the drill bit body and includes an axial roller bearing 5 and a roller bearing 6 comprising a row of conical rollers.

The rotary cutter is further supported in radial roller bearings 32 and 33 conprising cylindrical rolling elements. The rollers of the outer radial roller bearing 32 engage the cylindrical surface 34 of the trunnion without a lateral guide shoulder while the rollers of the radial bearing 33 are laterally guided in a bearing race groove 35 formed in an intermediate stepped portion of the trunnion to provide a relatively large guide surface at the inner end of the inner axial end face of the rollers 33. As illustrated the rollers for the radial bearings 32 and 33 engage outer raceway surfaces formed integrally in the interior peripheral surface of the rotary cutter 1. By this arrangement, the rollers of the two radial bearings 32 and 33 run directly on the bore of the rotary cutter; in other words without the use of an intermediate outside bearing race ring, and to be sure the rollers of the radial bearing 32 engage in the bearing race groove 36 and the rollers of the radial bearing 33 in the race groove 37. The bearing race groove 37 is bounded on the side facing the rotary drill bit by a guide shoulder 38 formed integrally in the rotary cutter 1. The rotary cutter 1 is, therefore, secured against displacement from the trunnion by means of the roller bodies and the raceway configurations described above.

In this embodiment of the invention a common filler opening for the rolling elements of the radial bearings 32 and 33 is provided which as illustrated extends essentially parallel to the axis of rotation of the rotary cutter and is formed in and extends from the drill bit body through the trunnion and terminates adjacent the radial shoulder defining one of the raceways for the conical rolling elements. More specifically the opening terminates adjacent the outer shoulder defining the outer support surface for the race groove 35.

The assembly of the rotary drill bit of FIG. 2 is essentially the same as the previously described embodiment. Thus the rotary cutter is assembled over the trunnion with the rolling elements for the bearings 5 and 6 in place. Thereafter, the rollers of the radial bearing 33 are advanced successively through the filler opening 12 until a full complement fills the annular space between the inner and outer raceways 35 and 37 of the radial bearing 33. Note that the radial distance 39 of the walls of the filling opening 12 from the shoulder 38 of the rotary cutter 1 is slightly larger than the diameter of the rollers of the radial bearing 33 so that a relatively small filling opening is all that is required and thereby minimize the weakening of the drill bit body 2 in the trunnion by reason of this construction. After inserting all of the rollers in the radial bearing 33, the race groove 35 may be sealed by suitable means; for example, a short temporary filler piece (not shown) in the base of the filling opening in order to prevent a fall back of the rollers in the filling opening 12 when subsequently the rollers of the radial bearing 32 adjacent the drill bit body are inserted through the same filling opening into the race groove 36 and below the rotary groove 1. After the full complement of rollers has been inserted for the outer radial bearing 32, the temporary filler piece is withdrawn from the filling opening and the permanent one-piece filler 40 is inserted into the opening to fill the same and secured in place by welds. The filler 40 seals the race 34 and the race groove 36 of the trunnion 3 and may be made of relatively soft inexpensive material; for example, weldable carbon steel, by reason of the fact that the filling opening is located in the radially less stressed zone of the radial bearings 32, 33; that is, the race grooves 34 and 35. The tip end of the filler 40 is contoured to conform and blend with the outer peripheral surface of the trunnion 3 so that no harmful corners or edges are present which may damage the seal 21 and the rolling elements of the radial bearings 32 and 33. Thus the tip end is of a stepped configuration having curved surfaces forming continuations of the raceways 34 and 35 which blend smoothly with the raceways formed in the trunnion.

There is illustrated in FIG. 3 still another embodiment of rotary drill bit in accordance with the present invention. The rotary cutter 1 is supported on the trunnion 3 of the drill bit body in essentially the same manner as the rotary cutter shown in FIG. 2. However, in the present instance an axially divided spacing ring 41 radially supported in the rotary cutter engages between the confronting axial end faces of the rollers 32 and 33. The rotary cutter is thus held in place via the shoulder 42 of the radial bearing 32 facing the drill bit body, a spacing ring 41 and the radial bearing 33 on the trunnion in such a way that it cannot be drawn off the trunnion 3. This embodiment likewise includes a filler opening and filler piece similar to that described in the FIG. 4 embodiment and the process for assembling the rollers through the filler opening is essentially the same as that described previously.

The rotary drill bit according to the invention has the distinct advantage that it is equipped with rotary cutters in a simple economic fabrication, which are held in place securely and impact resistant against being drawn off their trunion via the roller bodies of at least one radial roller bearing.

Moreover, the rotary drill bit according to the invention is not limited to the above described exemplified embodiments. It can rather be modified within the scope of the basic concept of the invention. For example, it is possible to insert through a common filling opening running essentially parallel to the axis of rotation of the rotary cutter, the rolling elements of more than two radial roller bearings between trunnion and rotary cutter whereby the filling opening exists then in all bearing races of the appropriate roller bearings. The filling opening can in addition also be used to insert the roller bodies of one or more axial roller bearings. The rolling elements of the individual roller bearings do not have to be constructed without a cage, in other words, rolls or spheres, they can rather be guided by conventional cages, segments or spacers.

Additionally, even though the filler piece 29 of the embodiment illustrated in FIG. 1 is held in a fixed, correct angular position in the filler opening by means of the weld 18 so that the arcuate portion **29*a* of the filler piece blends smoothly with the raceway surface 24 of the bearing 19, other arrangements are possible. Note the filler piece 29 correctly locates the filler piece 28 by interengagement of the projection 28*a* in the pocket 31. For example, the filler piece 29 may be restrained against rotational movement in a fixed position by means of a lock pin. Alternatively, the filler opening and the filler piece may be at least in part of a complementary non-circular cross section, for example, rectangular, thereby to hold the filler piece against rotation in the opening. Alternatively, the filler piece may have radial openings in which set screws or similar securing members engage and which are inserted through the roller bit body. Additionally, note that the inner axial end face of the filler piece remote from the rolling elements is biased or slanted relative to the filler piece axis in order to be flush with the plane of the drill bit body contour and in this position, the surface 29*a* of the filler piece defining a portion of the raceway 28 for the rolling elements of bearing 19** blend smoothly with the raceway. Accordingly, any angular displacement of the filler piece in the opening from this position would show itself on the surface of the drill bit body, i.e. the axial end face of the filler piece would then at least partly protrude out of the plane of the drill bit body. This would, of course, be visual indicia of incorrect positioning of the filler piece in the opening and would indeed cause difficultly in providing the weldment holding the filler piece in place.

What is claimed is:

1. In a rotary drill bit having a drill bit body and at least one trunnion projecting from the drill bit body and a rotary cutter supported on at least one pair of radial rolling bearings on the trunnion, means for guiding the rolling elements of said bearings on at least one axial end facing the drill bit body in an outer bearing race groove incorporated in the bore of the rotary cutter, means defining an inner bearing race groove on the trunnion for the rolling elements of said radial rolling bearing and means defining at least one filling opening arranged in the drill bit body to provide a common filling means for each radial rolling bearing, said filling opening extending essentially axially parallel to the axis of the trunnion in the non-loaded zone of the trunnion having one terminal end adjacent the inner bearing race groove and at least one filler piece for sealing the opening.

2. In a rotary drill bit having a drill bit body and at least one trunnion projecting from the drill bit body and a rotary cutter supported on at least one pair of radial rolling bearings on the trunnion, means for guiding the rolling elements of said bearings on at least one axial end facing the drill bit body in an outer bearing raceway in the bore of the rotary cutter, means defining an inner bearing raceway on the trunnion for the rolling elements of said radial rolling bearing and means defining at least one filling opening arranged in the drill bit body to provide a common filling means for each radial rolling bearing, a filler member engaging in said filling opening comprising at least two filler elements, one of said filler elements having a surface complementing and forming a part of the inner raceway for one of said bearings and the other filler member having a surface complementing and forming a part of the inner raceway for the other bearing.

3. In a rotary drill bit as claimed in claim 2 wherein the innermost filler element has a projection which seats in a recess in the outermost filler member thereby to secure the filler members against rotational movement relative to one another.

4. In a rotary drill bit as claimed in claim 2 wherein said one filler element also includes a second surface complementing and forming a part of the inner raceway for said other bearing.

* * * * *